US005475765A

United States Patent [19]

Lyth

[11] Patent Number: 5,475,765

[45] Date of Patent: Dec. 12, 1995

[54] IMPROVEMENTS IN OR RELATING TO LOUDSPEAKERS

[76] Inventor: Charles D. Lyth, Cloon Eavin, Sandhills Lane, Virginia Water, Surrey.GU25 4AB, England

[21] Appl. No.: 334,844

[22] PCT Filed: Oct. 19, 1990

[86] PCT No.: PCT/GB90/01614

§ 371 Date: Apr. 17, 1992

§ 102(e) Date: Apr. 17, 1992

[87] PCT Pub. No.: WO91/06191

PCT Pub. Date: May 2, 1991

Related U.S. Application Data

[63] Continuation of Ser. No. 216,042, Mar. 22, 1994, abandoned, which is a continuation of Ser. No. 848,950, Apr. 17, 1992, abandoned.

[30] Foreign Application Priority Data

Oct. 20, 1989 [GB] United Kingdom ..... 8923681

[51] Int. Cl.[6] ..... H04R 25/00

[52] U.S. Cl. ..... 381/188; 381/192

[58] Field of Search ..... 381/199, 194, 381/192, 201, 188, 203, 193; 29/594

[56] References Cited

U.S. PATENT DOCUMENTS

| | | | |
|---|---|---|---|
| 1,808,297 | 2/1931 | Dempster et al. . | |
| 1,820,585 | 8/1931 | Tolerton . | |
| 2,593,031 | 4/1952 | Howatt | 381/116 |
| 3,250,862 | 5/1966 | Rollins | 381/193 |

FOREIGN PATENT DOCUMENTS

| | | | |
|---|---|---|---|
| 0116646 | 2/1943 | Australia | 381/194 |
| 1041547 | 10/1953 | France | 381/199 |
| 2607390 | 8/1977 | Germany . | |
| 2842999 | 4/1980 | Germany . | |
| 5677197 | 11/1982 | Japan . | |
| 0400119 | 10/1933 | United Kingdom | 381/197 |
| 2108355 | 5/1983 | United Kingdom | 381/194 |

OTHER PUBLICATIONS

"Heat Dissipation and Power Compression in Loudspeaders", Douglas J. Button, pp. 32–41, J. Audio Eng Soc., vol. 40, No. ½ 1992 Jan./Feb.

*Primary Examiner*—Curtis Kuntz
*Assistant Examiner*—Huyen D. Le
*Attorney, Agent, or Firm*—Christie, Parker & Hale

[57] ABSTRACT

A chassis for a loudspeaker assembly comprising a diaphragm and a chassis. The chassis is situated in front of the diaphragm of the loudspeaker. The chassis comprises a central member which is provided with an aperture so that it can be connected to the center pole of a magnet. Extending from the central member to an outer flange are a plurality of spokes or a perforated member which provide protection for the diaphragm.

17 Claims, 2 Drawing Sheets

IMPROVEMENTS IN OR RELATING TO LOUDSPEAKERS

CROSS-REFERENCE TO RELATED APPLICATION

This is a continuation of application Ser. No. 08/216,042, filed Mar. 22, 1994, now abandoned, which is a continuation of application Ser. No. 07/848,950, filed Apr. 17, 1992, now abandoned.

BACKGROUND OF THE INVENTION

The present invention relates to improvements in or relating to loudspeakers and more particularly, though not exclusively, to .an improved chassis for a loudspeaker.

A loudspeaker is a device for converting variations in electrical energy into corresponding variations of acoustic energy or sound. A loudspeaker comprises a permanent magnet whose field acts on a current carrying conductor causing it to move at right angles to the lines of magnetic force. The conductor is coupled to a resiliently mounted diaphragm which causes it to move such that the diaphragm vibrates in relation to the current variations and transmits these vibrations to the air as sound waves.

In moving coil loudspeakers the armature which vibrates in the magnetic field comprises a coil attached to a conical diaphragm. In such a speaker the moving coil oscillates inside an electromagnet which is energised to a direct current.

In a permanent magnet moving coil speaker the coil oscillates in the annular cavity of a specially shaped permanent magnet and it is for this type of speaker which the invention has particular application, although it is to be understood that the invention is in no way limited to such a speaker type.

A typical moving coil loudspeaker employs a magnet and a chassis (the hardware) along with the coil, diaphragm and suspension system (the software). The magnet is heavy and needs to be supported by the chassis which also ensures alignment of the software relative to the voice coil gap. This alignment is essential to allow free movement of the coil within the voice coil gap.

Traditionally chassis are either metal pressings, metal castings or plastic mouldings, and these are placed behind the cone or dome of a speaker.

A problem with moving coil speakers is that when they are used at high powers, the voice coil heats up rapidly, resulting in an increased resistance, and a subsequent drop in power. Therefore, in order to allow for continued application at high power, without risk of damage to the components of the speaker, the heat produced must be dissipated. Due to the structure of speakers, the heat produced by the coil is currently dissipated by heat transfer to the magnet structure and chassis. Since the magnet structure and chassis are at the back of the speaker, and since speaker cabinets are usually lagged, the air inside the speaker is ultimately warmer resulting in a reduced efficiency of heat loss and a worsening of the situation.

For example, a voice coil with a dc resistance of 5 ohms at room temperature can, when driven at high power from an amplifier, have an effective d.c. resistance of 10 ohms. How much power the coil will accept before physical damage, i.e. breakdown of the insulating varnish on the wire or bonding adhesives, depends on the type of varnish and adhesive used. Since adhesives can run at much higher temperatures than those available thirty years ago, coils can withstand a greater power input and can be run at temperatures of around 200°–250° C. This increase in operating temperatures allowed by modern materials exacerbates the problem of increased voice coil resistance at high powers.

A coil will draw power from an amplifier according to the basic formula $$\frac{\text{power} = (\text{voltage})^2}{\text{resistance}}$$

Thus a doubling of resistance means that half power is drawn. Expressed logarithmically using decibels, this translates into a power compression of three decibels and is equivalent to a loss of speaker sensitivity of three decibels when the speaker in this example is run at high power levels. The change in voice coil resistance also modifies other speaker parameters affecting the performance in the bass frequencies.

Thus, in order to increase speaker power and improve speaker quality, it is necessary to reduce the heat increase of the coil.

The heat produced in the voice coil is lost to the magnet assembly and chassis by a process of radiation and conduction. Since the magnet and chassis are behind the cone assembly, the heat is transferred rapidly to the cabinet. The result is that the cabinet air becomes warmer resulting in a reduced efficiency of heat loss and as a result of acoustic wadding a lagging effect worsens the situation. As power to the speaker is increased there is an increase in acoustic output and an increase in voice coil temperature. This results in an increase in the d.c. resistance of the coil preventing it from drawing as much power as it would if it were cold. The power handling capacity of the speaker is thus set by the maximum allowable temperature of the voice coil in conjunction with the ability of the software to withstand the mechanical and thermal forces imposed on it. The usual solution to this problem is to increase a loudspeaker's thermal power handling capacity by the use of larger coils which increase the area from which heat can be lost to the surrounding metalwork.

SUMMARY OF THE INVENTION

One object of the present invention has been to design a speaker which can dissipate the heat produced from the coil more efficiently so that speaker power can be increased and speaker performance improved.

A benefit of lowering the coil temperature is that it is possible to use a smaller diameter voice coil and correspondingly smaller magnets to achieve the same power and performance as speakers with conventionally larger voice coils and magnets.

Such an object has been achieved by the provision of a new type of chassis, which chassis can absorb heat from the coil and release it to the outside of the cabinet, enabling more efficient cooling of the coil with a corresponding performance increase.

According to one aspect of the present invention there is provided a loudspeaker assembly comprising a magnet, a diaphragm and a chassis, which chassis is situated in front and inside of said diaphragm in the loudspeaker which assembly is further characterised in that the rear and outside of the diaphragm is substantially chassis free.

Preferably the diaphragm is in the form of a cone or ring radiator and the chassis comprises a central member adapted to be attached to the centre pole of a magnet, an outer flange and means connecting the central member to the outer flange. Preferably this connecting means comprises at least three spokes, each spoke extending from the central member to the outer flange. More preferably still the flange is dimensioned to allow minimal protrusion of the spokes beyond the panel into which the loudspeaker is mounted. Alternatively the chassis might be produced in a perforated sheet, in which case the sheet itself will provide the means connecting the central member and the outer flange.

Since chassis are optimised for a particular application requiring specific software dimensions, there is no such thing as a standard chassis. For example, a bass unit requiring a long coil, deep cone and possibly two rear suspensions, in having a large coil excursion, will require a deep chassis. A mid-range unit requiring a shallower cone short coil and single rear suspension with a small excursion will not need such a deep chassis.

It is usual to arrange for the cone suspension and coil to be glued together at one point for optimum structural strength. If a common chassis is to be used it is often necessary to compromise the structure of the software with a resulting performance constriction.

A further object of the present invention is to provide a chassis which can be used over a wide range of applications. This has, in part, been achieved by designing a chassis which can be fitted in front of the cone or ring radiator of a speaker.

Accordingly, there is provided a chassis, adapted to be fitted in front of a diaphragm of a speaker, comprising a central member adapted for attachment to a centre pole of a magnet, an outer flange with means for attachment of a front suspension thereto and means connecting said central member to said outer flange characterised in that said means connecting said central member to said outer flange extends inwards from the outer flange inside of the diaphragm to terminate at said central member.

Preferably the central member and outer flange are connected by a plurality of spokes.

Preferably the means for attachment of the front suspension is in the form of a first face or glueing land on the underside of the flange.

More preferably still, the chassis will be provided with a second face for the attachment thereto of a further suspension.

An embodiment of the invention will now be illustrated by way of example only, with reference to the accompanying drawings, in which:

DESCRIPTION OF THE PREFERRED EMBODIMENT

Figure 1:
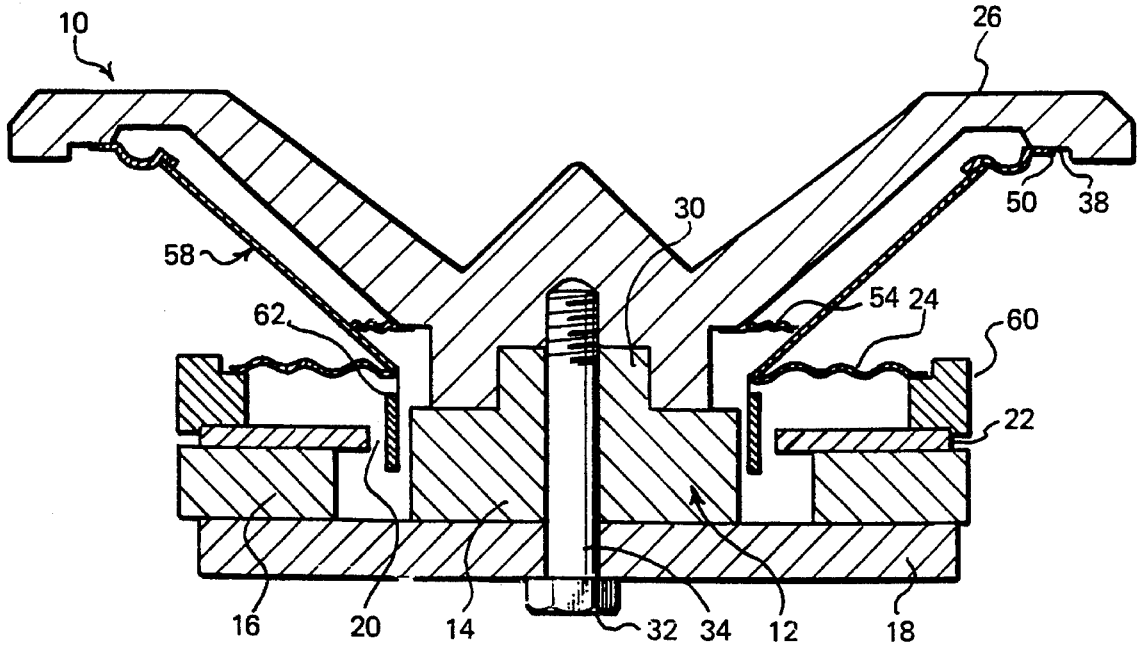
FIG. 1 is a diagrammatic representation of a loudspeaker assembly, according to one aspect of the present invention.

FIG. 1 shows a loudspeaker assembly 10. It comprises a magnet 12 having a centre pole 14 and a ceramic ring 16. The ceramic ring is mounted on a back plate 18 and there is a gap, the voice coil gap, 20, between the centre pole 14 of the magnet 12 and a front plate 22 via a suspension support 16.

The front plate 22 is seated on the ceramic ring 16 of the magnet 12 and has a rear suspension 24 fitted thereto.

Traditionally a speaker chassis is fitted to the front plate, which chassis supports the software comprising the suspension, coil and diaphragm. A diaphragm is usually in the form of a cone or dome and traditionally the chassis is situated external to the cone or dome.

The chassis 26 of the present invention is fitted to the centre pole 14 of the magnet 12, which chassis 26 then supports the software. Thus, in the present invention a chassis is internal to the cone.

The chassis 26 has a recess 28 thereon, which recess locates with a boss 30 extending from the centre pole of the magnet 12. The chassis is attached to the magnet by means of a bolt 32 which passes through a bore 34 in the centre pole of the magnet and into a bolt-receiving aperture 36 in the chassis. Alternatively the bolt may pass through the chassis and into the centre pole. In fact, screwing the chassis into the magnet is preferred. The longitudinal axis of the chassis recess 28 lies at right angles to the plane of the front glueing land 38 of the chassis. The boss 30 has an axis which coincides with that of the chassis so that a high degree of precision can be attained when the magnet and chassis are fitted together.

Figure 2:
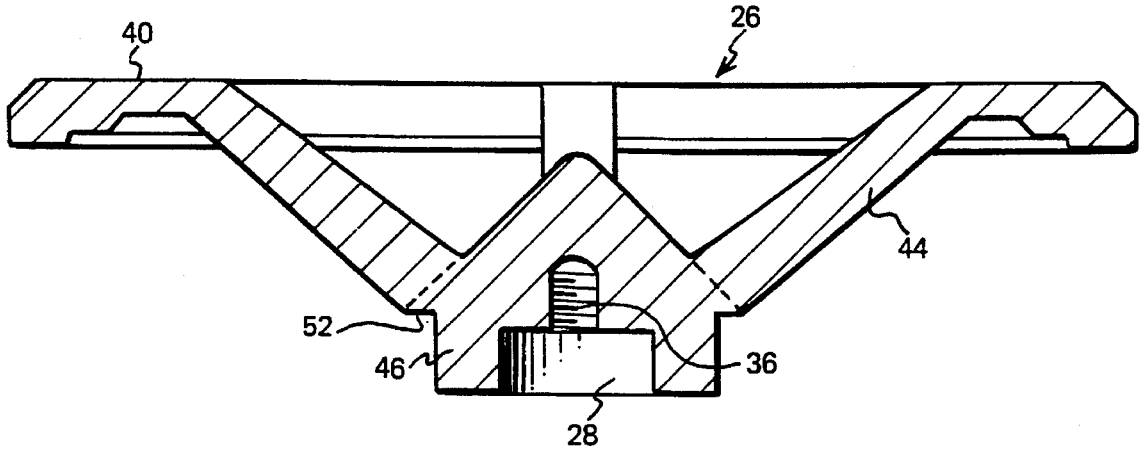
FIG. 2 is a cross-section through the chassis illustrated in FIG. 1.
Figure 3:
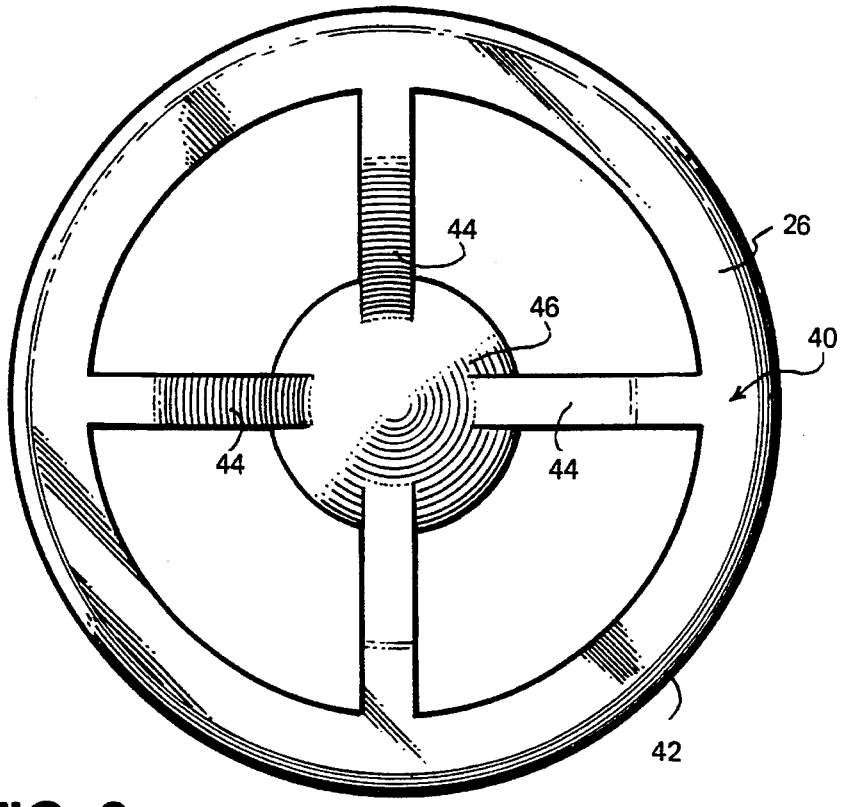
FIG. 3 is a plan view from above of the chassis illustrated in FIG. 1.
Figure 4:
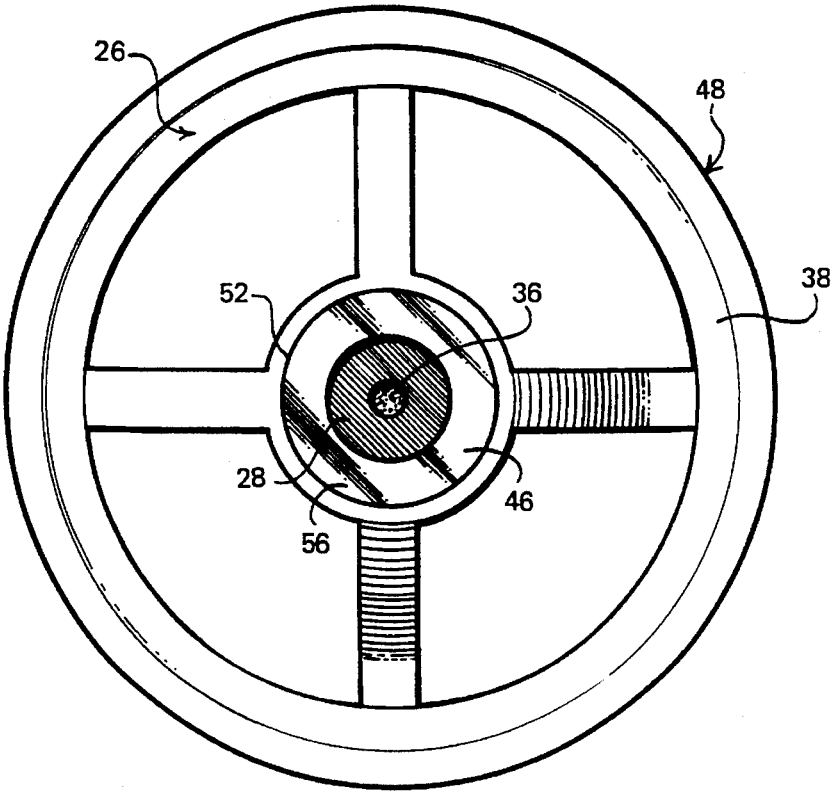
FIG. 4 is a plan view from below of the chassis illustrated in FIG. 2.

Referring to FIGS. 2 to 4, it will be apparent that the chassis 26 is multi-spoked. It comprises an outer flange 40 which is annular in shape and has a bevelled outermost edge 42. The outer flange is dimensioned to allow minimal protrusion of the spokes beyond the panel into which the loudspeaker is mounted. Extending inwards from the outer flange 40 are a plurality of spokes 44, which spokes terminate at a central core 46, which core 46 is generally conical in shape.

Since the core shape and volume will affect the upper end of the loudspeaker frequency range, its shape can be varied so as to provide optimum mechanical strength and optimum acoustic performance. Central core 46 has a recess 28 formed therein for accommodating a boss 30 of a magnet 12. It also has formed therein an aperture 36 for receiving a bolt 32. The underside 48 of the chassis has a plurality of steps and grooves therein for the attachment of various software components thereto. A glueing land or first face 38 accommodates a front suspension 50 and a second face 52 may accommodate a second rear suspension 54. The bottom face 56 of the chassis is designed to abut the centre pole of a magnet 12.

In the speaker system 10 the chassis 26 is attached to the centre pole 14 by a bolt 32. The chassis 26 supports the software from inside of the cone 58. Attached to the first face or glueing land 38 of the chassis there is a front suspension 50. This is in turn attached to the cone 58 which extends down to and is attached to the rear suspension 24, which is in turn fitted to the front plate 22 via a suspension support 60. Attached where the rear suspension 24 and cone 58 meet is a coil 62 which extends downwards into the gap 20.

By arranging the spokes as described, the chassis is able to provide protection to the cone. Furthermore, since the magnet is supported by its centre pole with the chassis structure in front of the cone assembly, the heat produced by the voice coil is dissipated to the outside of the loudspeaker. Furthermore, by locating the magnet from its centre pole it is easy and cost effective to vary its position relative to the front glueing land, allowing a wide variation of cone heights and voice coil lengths to be achieved.

Furthermore, since the centre core of the chassis reduces the volume (and hence the mass) of air directly in front of the cone, an improvement at the upper end of the loudspeaker frequency response results. Additionally, the acoustic loading of the speaker can be altered by reducing the inner diameter of the outer flange.

Additionally, the single bolt attachment of the chassis to the magnet ;allows easy assembly of the speaker and allows easy access for altering the rear suspension sub-assembly to optimise it for given applications.

Precise alignment of the magnet assembly to the chassis is ensured by the boss on the end of the pole locating in a matching recess in the chassis. Alternatively, this male/female mating arrangement can be reversed. Location of the rear suspension assembly onto the front plate of the magnet also ensures a high accuracy of alignment of the axis of the voice coil motion with that of the magnetic gap. This fine accuracy of alignment results in a better sound quality.

I claim:

1. A moving coil loudspeaker assembly having a speaker diaphragm, and a magnet and voice coil both positioned substantially behind the diaphragm, the voice coil attached to the diaphragm and oscillating in an air gap adjacent the magnet to drive the diaphragm, and a chassis in front of the diaphragm in a position to support the diaphragm and the magnet, the chassis also providing the sole means of structural support for the magnet, the chassis comprising (a) a central member having one connecting member of a male/female mating arrangement for attachment to a center pole of the magnet which includes a complementary connecting member of the male/female mating arrangement, (b) an outer flange with means for attaching a front suspension of the diaphragm thereto, and (c) connecting means extending from the outer flange inwardly to terminate at and provide a direct means of connection to the central member, the connecting means extending inwards from the outer flange and inside an open space occupied within the front side of the diaphragm in front of the magnet, the central member of the chassis supporting the center pole of the magnet for aligning the central member and the center pole, the chassis aligning the voice coil in the air gap relative to the magnet via the support provided by the chassis central member's attachment to the center pole of the magnet, the rear and outside of the diaphragm being substantially chassis free so the connecting means of the chassis provide a major path of heat dissipation for the heat generated by operation of the voice coil from the rear-mounted magnet through the connecting means on the front side of the speaker diaphragm toward the outer flange.

2. A chassis as claimed in claim 1 wherein said means connecting said central member to said outer flange is a plurality of spokes.

3. A chassis as claimed in claim 1 in which said means connecting said central member to said outer flange is a perforated sheet.

4. A chassis as claimed in claim 1 in which said means for attachment of the front suspension is in the form of a first face for gluing land on the underside of the flange.

5. A chassis as claimed in claim 4 which further comprises a second face for the attachment thereto of a further suspension.

6. A chassis as claimed in claim 1 in which said central member has a central core which is generally conical in shape.

7. A chassis as claimed in claim 1 wherein the connecting means comprises one or more connecting members integral with the outer flange and rigidly affixed to the magnet and extending solely along the front side of the diaphragm to provide said major path of heat dissipation.

8. A moving coil loudspeaker assembly comprising a chassis which supports a magnet and a diaphragm, the chassis having a central member, the magnet having a center pole supported by the central member of the chassis for aligning the central member and the center pole, the chassis comprising the sole structural support for the magnet, in which a voice coil attached to the diaphragm oscillates in an air gap adjacent the magnet to drive the diaphragm, the chassis aligning the voice coil in the air gap relative to the magnet via the support provided by the chassis central member's support of the center pole of the magnet, and in which the magnet and voice coil are both positioned substantially behind the diaphragm, the chassis being situated in front of and substantially inside the space occupied by said diaphragm and in front of the magnet in the loudspeaker, and in which the rear and outside of the diaphragm is substantially chassis free, so that heat generated by the operation of the voice coil is dissipated to the front of the speaker assembly by the front-mounted chassis which supports the magnet and the diaphragm.

9. A loudspeaker assembly as claimed in claim 8 in which said diaphragm is in the form of a cone.

10. A loudspeaker assembly as claimed in claim 8 in which said diaphragm is in the form of a radiator.

11. A loudspeaker assembly as claimed in claim 8 in which said chassis comprises a central member adapted to be attached to the centre pole of said magnet.

12. A chassis as claimed in claim 11 in which said chassis further comprises an outer flange and means connecting said central member to said outer flange.

13. A loudspeaker assembly as claimed in claim 11 in which said chassis further comprises an outer flange and connecting said central member to said outer flange is a plurality of spokes.

14. A loudspeaker assembly as claimed in claim 11 in which said chassis further comprises an outer flange and connecting said central member to said outer flange is a perforated sheet.

15. A loudspeaker assembly as claimed in claim 11 in which said central member is provided with one member of a male/female mating arrangement and the centre pole of the magnet is provided with the complementary member of the male/female mating arrangement.

16. A loudspeaker assembly as claimed in claim 11 in which said central member has a central core which is generally conical in shape.

17. A loudspeaker assembly as claimed in claim 8 in which the loudspeaker assembly is a permanent magnet moving coil speaker.

* * * * *